United States Patent [19]

Hotchkiss et al.

[11] 3,966,074

[45] June 29, 1976

[54] TERMINAL BOX AND COVER

[75] Inventors: Kenneth W. Hotchkiss, Golden; George A. Kopp, Sr., Boulder, both of Colo.

[73] Assignee: Proto Production Plastics, Inc., Boulder, Colo.

[22] Filed: Apr. 28, 1975

[21] Appl. No.: 572,116

[52] U.S. Cl. ..... 220/3.8; 174/72 A; 174/138 F; 220/356; 339/198 J

[51] Int. Cl.[2] ..... H01R 13/44; B65D 43/10

[58] Field of Search ..... 220/3.8, 306, 307, 356, 220/357; 174/66, 72 A, 138 F; 339/36–39, 198 J

[56] References Cited

UNITED STATES PATENTS

| | | | |
|---|---|---|---|
| 2,774,472 | 12/1956 | Badalich | 220/306 X |
| 2,921,607 | 1/1960 | Caveney | 174/72 A X |
| 3,335,900 | 8/1967 | Mackiewicz | 220/306 |
| 3,485,937 | 12/1969 | Caveney | 174/72 A X |
| 3,528,583 | 9/1970 | Taylor | 220/306 X |
| 3,683,314 | 8/1972 | Elkins | 174/138 F X |
| 3,705,949 | 12/1972 | Weiss | 174/72 A X |
| 3,777,223 | 12/1973 | Chandler et al. | 174/72 A X |
| 3,836,826 | 9/1974 | Hotchkiss et al. | 174/72 A X |
| 3,846,737 | 11/1974 | Spaulding | 220/307 X |

*Primary Examiner*—William Price
*Assistant Examiner*—Stephen Marcus
*Attorney, Agent, or Firm*—Bertha L. MacGregor

[57] ABSTRACT

A terminal box and cover in which the box has parallel longitudinal side walls comprising longitudinally spaced apart straight sided members terminating in flat tops which overhang the spaces between them, and the cover has a flat top and depending side walls provided with latch devices on their inner side surfaces which enter the spaces in the box side walls and engage the under surfaces of the tops of said box side wall members. The cover end walls have spacer blocks on their inner surfaces which bear on the upper edges of the box walls when the cover is in place on the box and prevent bearing of the cover top on connectors mounted in the terminal box. The latch devices on the cover side walls do not occupy any space between the respective side walls of the box and cover when the cover is in place on the box, and thus permit the cover to have a close fit on the box side walls.

2 Claims, 4 Drawing Figures

TERMINAL BOX AND COVER

BACKGROUND OF THE INVENTION

This invention relates to terminal boxes and covers therefor used in telephone installation equipment.

Improvements over prior art terminal boxes and covers have been disclosed in U.S. Pat. No. 3,836,826, granted Sept. 17, 1974 to Kenneth W. Hotchkiss and Gerald S. Byers. The invention shown and described in this application discloses additional improvements in the box and cover to provide firm, dependable mounting of the cover on the box for protection of the contents, and especially simple construction of the box side walls which cooperate with the cover walls for said mounting.

SUMMARY OF THE INVENTION

This invention provides mounting means on the cover side walls which engage the terminal box side walls. The mounting means consist of straight walled side members in which are eliminated the outwardly thickened, overhanging side members used in the terminal box of the aforementioned U.S. Pat. No. 3,836,826. In addition to the simplification of the box construction, the box engaging means on the cover are positive latch type devices which enter the spaces between the box side wall members and contact the said spaced apart side wall members in areas between them without consuming any space between the inside of the cover side walls and the outer surfaces of the box side wall members. Further, spacers on the inner surfaces of the cover end walls bear on the box end wall edges and thus control the exact placement of the cover on the terminal box without bearing on the connectors in the box. These features provide a compact combination box and cover, firmly assembled and occupying minimum space when mounted on a wall.

OBJECTS OF THE INVENTION

One object of the invention is to provide a terminal box and cover provided with engaging parts which are simple in construction and ensure firm seating of the cover on the box without bearing on the connectors located in the box.

Another object is to provide latch type box-engaging means on the cover which enter spaces between side wall members of the box without consuming any space between the inner surfaces of the cover side walls and outer surfaces of the box side walls.

Another object is to eliminate the need for providing overhanging side wall members in the terminal box for engagement by ribs or other protruding parts on the proximate surfaces of the cover side walls which heretofore have occupied space between said box and cover side walls and prevented desirable close fit between said side walls.

DESCRIPTION OF THE PREFERRED EMBODIMENT

Figure 1:
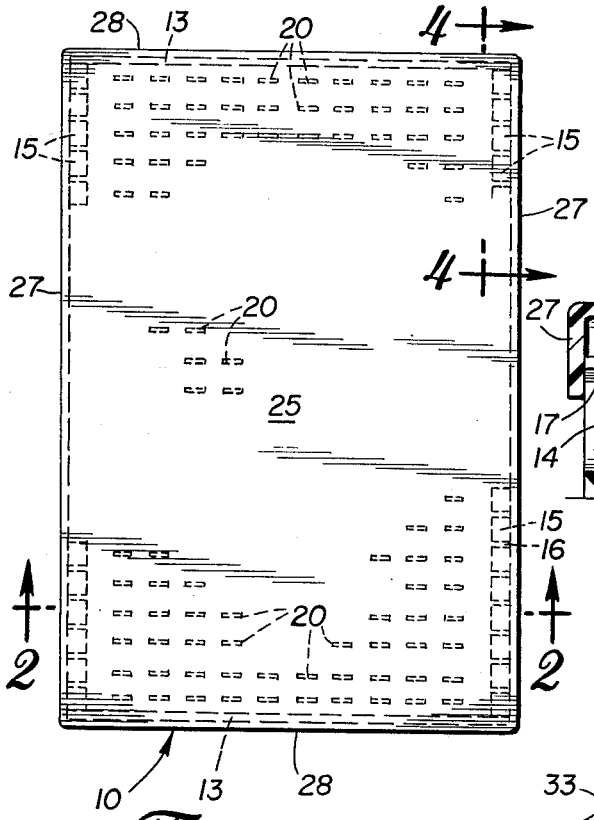
FIG. 1 is a front view of a terminal box and cover such as are used in telephone installation equipment.
Figure 2:
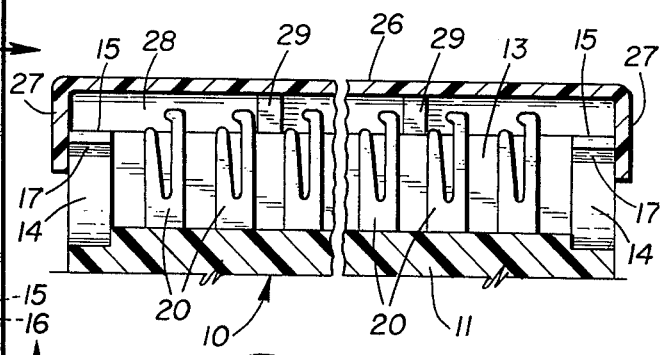
FIG. 2 is a transverse sectional view on an enlarged scale in the plane of the line 2—2 of FIG. 1.
Figure 4:
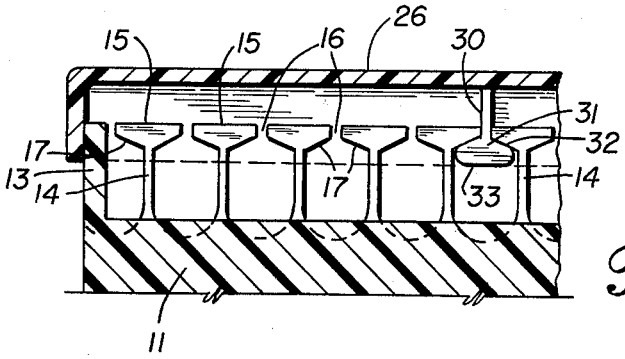
FIG. 4 is a fragmentary longitudinal sectional view on an enlarged scale, in the plane of the line 4—4 of FIG. 1.

The terminal box 10, as a whole, comprises a rectangular base 11, longitudinal side walls 14 and end walls 13, which may be integrally formed or otherwise suitably constructed. As shown in the drawings, the base 11 merges into side walls comprising relatively narrow upright members 14 which terminate in flat tops 15 spaced from each other by spaces 16. The spaces 16 extend transversely of the box as shown in FIGS. 1 and 4. The tops 15 are generally square or rectangular in area and overhang the spaces 16. The lower surfaces of the tops 15 are designated 17.

Conventional connectors 20 are mounted on the base 11 in rows extending across the box 10 between the oppositely located side walls 14.

Figure 3:
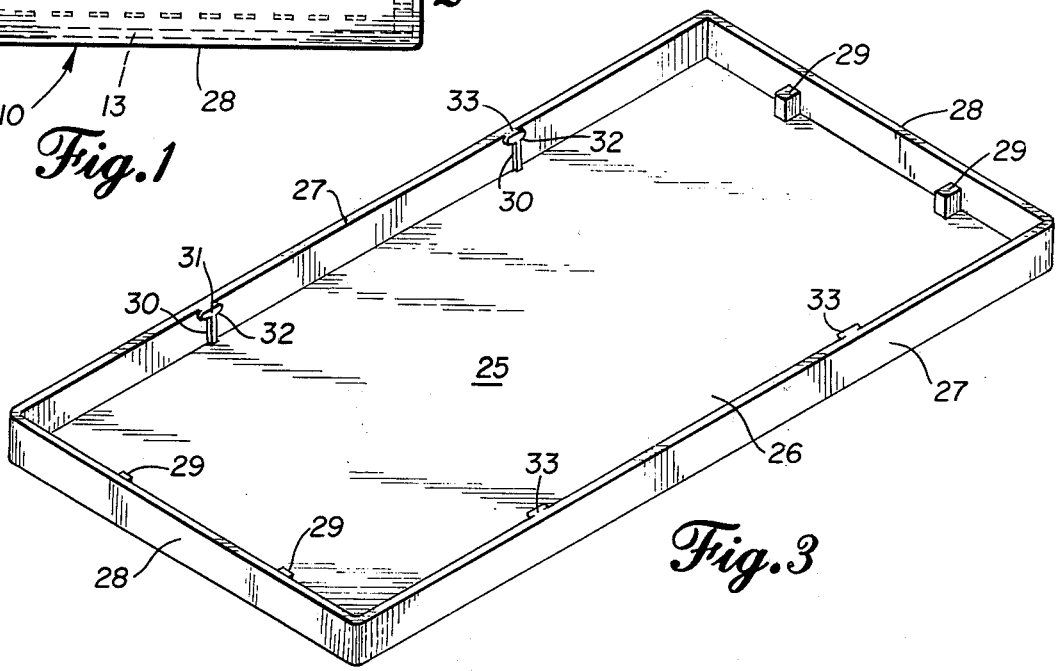
FIG. 3 is a perspective view of the inside of the terminal box cover removed from the box and inverted.

The cover designated 25 as a whole, FIG. 3, comprises a flat top 26, longitudinal side walls 27 and end walls 28, which may be integral with each other, the dimensions being such that the cover fits over and around the box walls 14 and 13 without space between adjacent surfaces of the respective walls.

The end walls 28 of the cover are provided with spacer blocks 29 preferably formed integrally with the inner surfaces of the end walls 28 to space the top of the cover from the top edges of the walls of the box.

The side walls 27 of the cover are provided on their inner surfaces with inwardly projecting latch members each consisting of a shank 30 extending from the top 26 and merging into a latch portion 31 by oppositely curved surfaces 32 adapted to engage the under sides 17 of box side wall tops 15. The surfaces 33 of the latch members are in the same horizontal plane as the bottom edge of the cover side walls 27 when the cover is in place on the box. The placement of the cover is performed by gentle pressing downwardly on the cover, with the cover depending walls 27, 28 engaging the outer surfaces of the box walls 14, 13, respectively, causing the cover latch portions 31 to enter the spaces 16 between the side wall tops 15, and the inclined surfaces 32 to engage the surfaces 17 of the box side wall tops 15.

Preferably the cover is made of transparent plastic material, but is not confined thereto.

We claim:

1. A terminal box and cover comprising a. a box having a bottom, opposite side walls and opposite end walls, said side walls comprising a plurality of side members spaced apart longitudinally of the box, each side member being provided with a top which has under surfaces overhanging part of the space between it and an adjacent side member, and b. a cover having a top, opposite side walls and opposite end walls, said cover side walls having a plurality of latch devices on their inner surfaces, said latch devices entering the spaces between the box side wall members and engaging the under surfaces of the said box side wall members when the cover is in place on the box, and said latch devices each comprising a shank extending downwardly from the cover top and terminating in an enlarged end that engages the under surfaces of the tops of adjacent box side wall members.

2. The terminal box and cover defined by claim 1, in which the cover side and end wall inner surfaces contact the box side and end wall outer surfaces, and the latch devices on the cover extend between the box side wall members without occupying any space between the cover and box side walls when the cover is in place on the box.

* * * * *